US006475054B1

(12) United States Patent
Liu

(10) Patent No.: US 6,475,054 B1
(45) Date of Patent: Nov. 5, 2002

(54) THREE-DIMENSIONAL BUILT-UP TOY WITH CHANGEABLE CLOTHES

(76) Inventor: Kuo-Ching Liu, 5Fl, No. 11, Alley 1, Lane 1, Sec. 1, Yunhan S. Rd., Lujou City, Taipei (TW)

( * ) Notice: Subject to any disclaimer, the term of this patent is extended or adjusted under 35 U.S.C. 154(b) by 0 days.

(21) Appl. No.: 09/951,424

(22) Filed: Sep. 14, 2001

(51) Int. Cl.[7] ..... A63H 3/36
(52) U.S. Cl. ..... 446/98; 446/387; 446/474
(58) Field of Search ..... 446/268, 296, 446/359, 365, 387, 388, 474, 97, 98

(56) References Cited

U.S. PATENT DOCUMENTS 2,395,118 A * 2/1946 Havel ..... 446/388
3,296,737 A * 1/1967 Doyle et al. ..... 229/125.11
3,753,312 A * 8/1973 Hughes, Jr. ..... 428/16

* cited by examiner

*Primary Examiner*—Jacob K. Ackun
(74) *Attorney, Agent, or Firm*—Troxell Law Office PLLC

(57) ABSTRACT

A three-dimensional built-up toy includes a doll, a coupling element, a plurality of clothes, and a base all in the form of flat pieces. The doll piece is provided at one side near a middle portion with a first slit having a predetermined depth for engaging with a second slit provided on one side of the coupling element, so that the coupling element is perpendicularly connected to the doll. The base is provided with a plurality of insertion slots, any of which is adapted to receive a lower connecting edge of the doll, so that the doll could stand on the base. Each of the pieces of clothes is provided at one side with a third slit for engaging with the coupling element and thereby being changeably attached to the doll via the coupling element at any time as desired.

4 Claims, 4 Drawing Sheets

THREE-DIMENSIONAL BUILT-UP TOY WITH CHANGEABLE CLOTHES

FIELD OF THE INVENTION

The present invention relates to a three-dimensional built-up toy with changeable clothes. The toy includes a plurality of flat pieces separately forming a doll, a coupling element, a plurality of clothes, and a base. The coupling element is perpendicularly connected to one side of the doll, and each piece of clothes is provided at one side with a slit for engaging with the coupling element. The pieces of clothes may be selectively attached to the doll through the coupling element depending on a consumer's imagination, enabling the doll to change clothes at any time.

BACKGROUND OF THE INVENTION

A conventional three-dimensional built-up toy is usually supplied in the form of a flat panel on which a plurality of flat pieces are formed through die cutting to provide a doll and a plurality of related parts. The flat pieces are removed from the panel for building up a three-dimensional toy according to the consumer's own ideas. The panel after removal of the doll and other parts is usually useless and discarded to form a source of environmental pollution. The doll is usually printed in the manufacturing process to show only one fixed style of clothes and therefore looks monotonous without funds and attraction. It is therefore tried by the inventor to develop a three-dimensional builtup toy with changeable clothes to eliminate the drawbacks existing in the conventional built-up toy.

SUMMARY OF THE INVENTION

A primary object of the present invention is to provide a three-dimensional built-up toy with changeable clothes, so that the toy is more interesting for playing. The toy mainly includes a plurality of flat pieces separately forming a doll, a coupling element, and a plurality of pieces of clothes. The doll is provided at one side near a middle portion with a first slit of a predetermined depth, and the coupling element is provided at one side with a second slit for engaging with the first slit, so that the coupling element is perpendicularly connected to the doll. Each piece of clothes is provided at one side with a third slit for engaging with the coupling element, so that the clothes are selectively attached to the doll via the coupling element depending on the consumer's own ideas, giving the doll different appearances.

Another object of the present invention is to provide a three-dimensional built-up toy with changeable clothes, so that the toy could stably stand on a base. To this purpose, the toy includes a plurality of flat pieces that are initially formed on a flat base through die cutting. By removing the plurality of flat pieces from the flat base, a doll, a coupling element, and a plurality of pieces of clothes are obtained. The doll is provided at a lower end with a downward extended connecting edge for engaging into one of many insertion slots formed on the remained flat base, so that the doll with the clothes changeably attached thereto via the coupling element could vertically stand on the flat base without the need of discarding the base.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
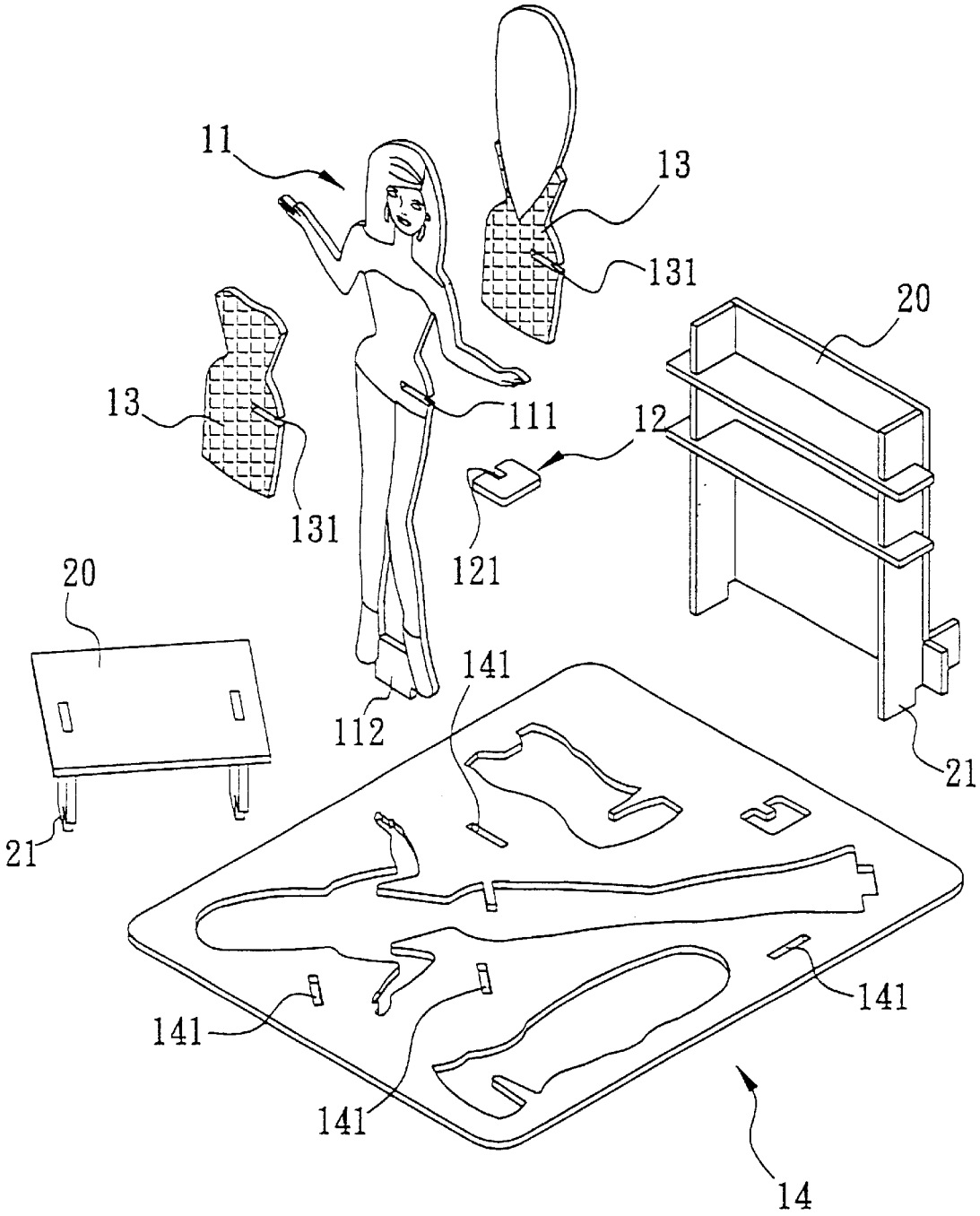
FIG. 1 is an exploded perspective view of a three-dimensional built-up toy with changeable clothes according to a first embodiment of the present invention.
Figure 2:
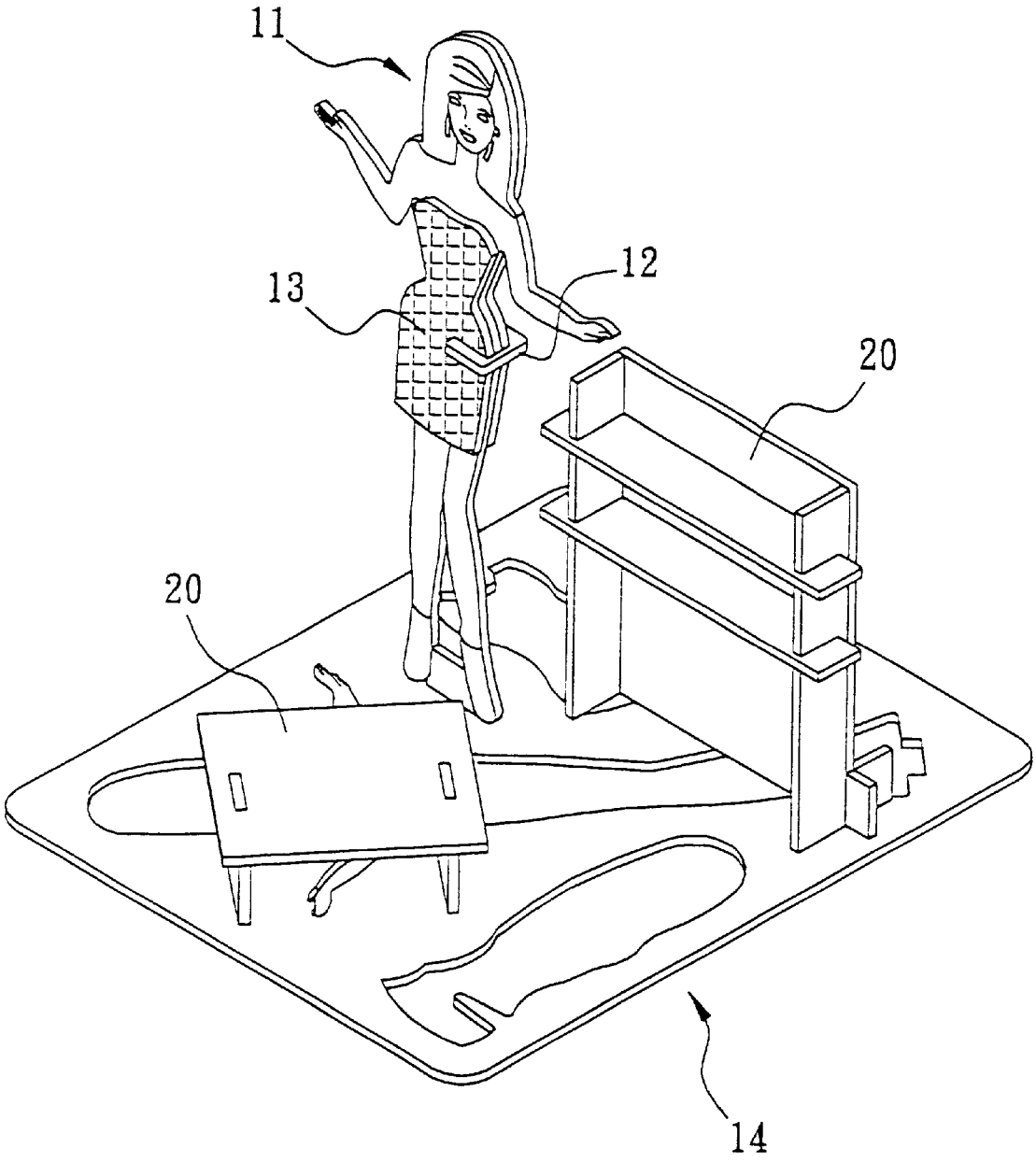
FIG. 2 is an assembled perspective view of FIG. 1.

Please refer to FIGS. 1 and 2 that are exploded and assembled perspective views, respectively, of a three-dimensional built-up toy according to a first embodiment of the present invention. In this first embodiment, the three-dimensional built-up toy mainly includes a flat piece of doll 11, a flat piece of coupling element 12, a plurality of flat pieces of clothes 13, and a flat piece of base 14.

The doll 11 is provided at one side near a middle portion with a first slit 111 having a predetermined depth. The coupling element 12 is provided at one side with a second slit 121. By engagement of the second slit 121 with the first slit 111, the coupling element 12 can be perpendicularly connected to the doll 11. The doll 11 also includes a downward extension projected from a lower end of the doll 11 to serve as a connecting edge 112. The base 14 is provided on a surface at predetermined positions with a plurality of insertion slot 141, into which the connecting edge 112 of the doll 11 is inserted for the doll 11 to stably stand on the base 14. Each piece of the clothes 13 is provided at one side at a position corresponding to the first slit 111 with a third slit 131. The third slit 131 is adapted to engage with the coupling element 12, so that the clothes 13 are selectively put onto the doll 11 by engaging the third slits 131 with the coupling element 12 that is connected to the doll 11 through engagement of the second slit 121 with the first slit 111 on the doll 11. A consumer may change the doll's clothes as desired by putting different pieces of clothes 13 onto the doll 11 in the above-described manner.

As can be seen in FIGS. 1 and 2, the base 14 is initially a complete flat panel from which the doll 11, the coupling element 12, and the a plurality of clothes 13 are produced through die cutting of the flat panel. The flat panel with the doll 11, the coupling element 12 and the clothes 13 removed therefrom is then further provided with the insertion slots 141 and used as a base 14 for the doll 11. The base 14 may be painted or printed to show different patterns to look like, for example, a floor. The connecting edge 112 of the doll 11 may be inserted into any one of the insertion slots 141 to stand on the base 14. In brief, the base 14 is fully utilized in the toy of the present invention without being discarded after the doll 11, the coupling element 12 and the clothes 13 are removed therefrom. The present invention is therefore environmentally friendly.

To make the toy more interesting for playing, some pieces of toy furniture 20 may be provided and attached to the base 14. The toy furniture 20 may be assembled from a plurality of flat pieces. Each piece of the toy furniture 20 is provided at lower ends with downward extended insertion edges 21. Through engagement of the insertion edges 21 with the insertion slots 141 on the base 14, the toy furniture 20 could stably stand on the base 14.

Figure 3:
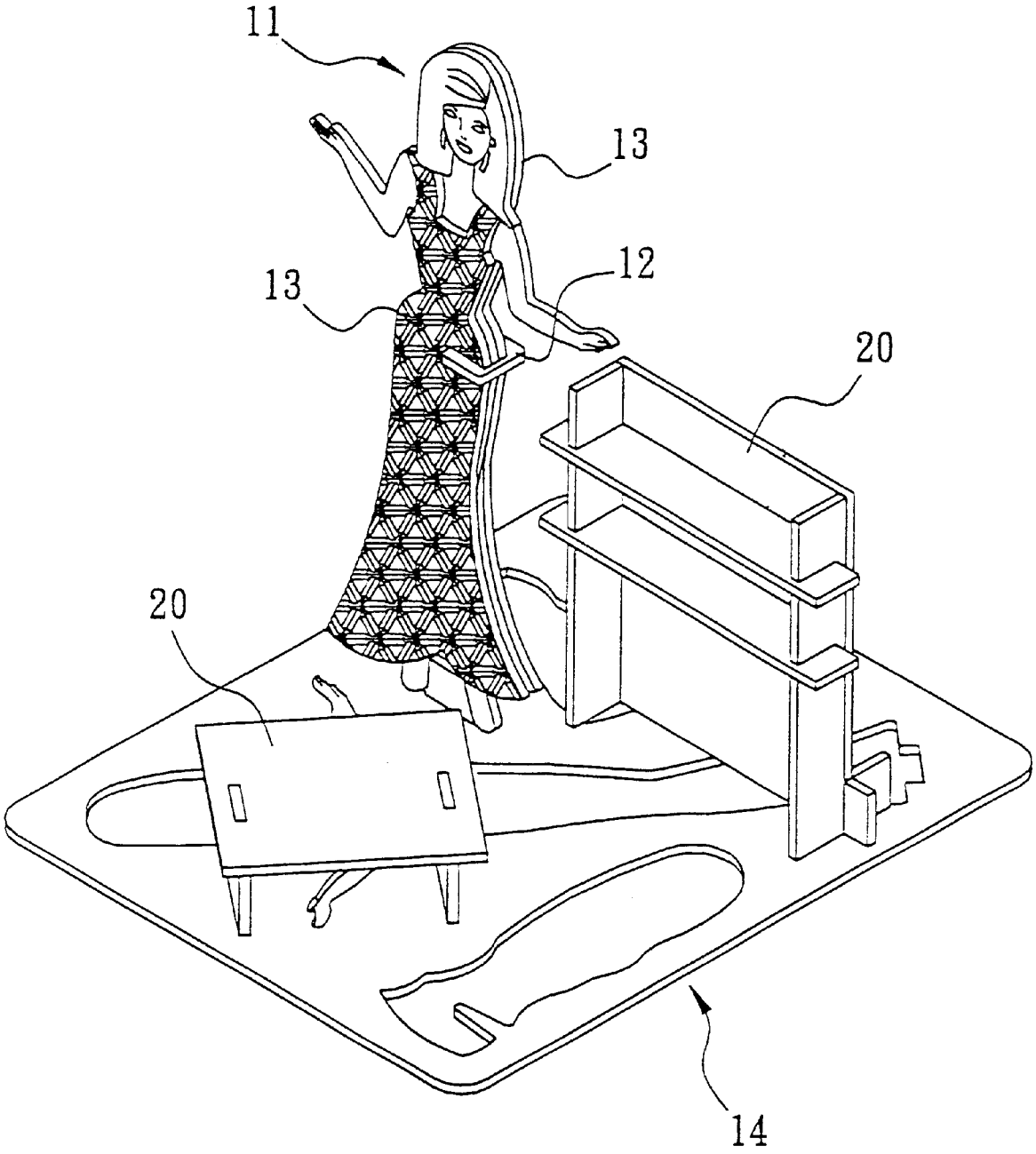
FIG. 3 is similar to FIG. 2 with the toy wearing different clothes.

FIG. 3 shows that the doll 11 in FIGS. 1 and 2 has changed her clothes and wears a gown now.

Figure 4:
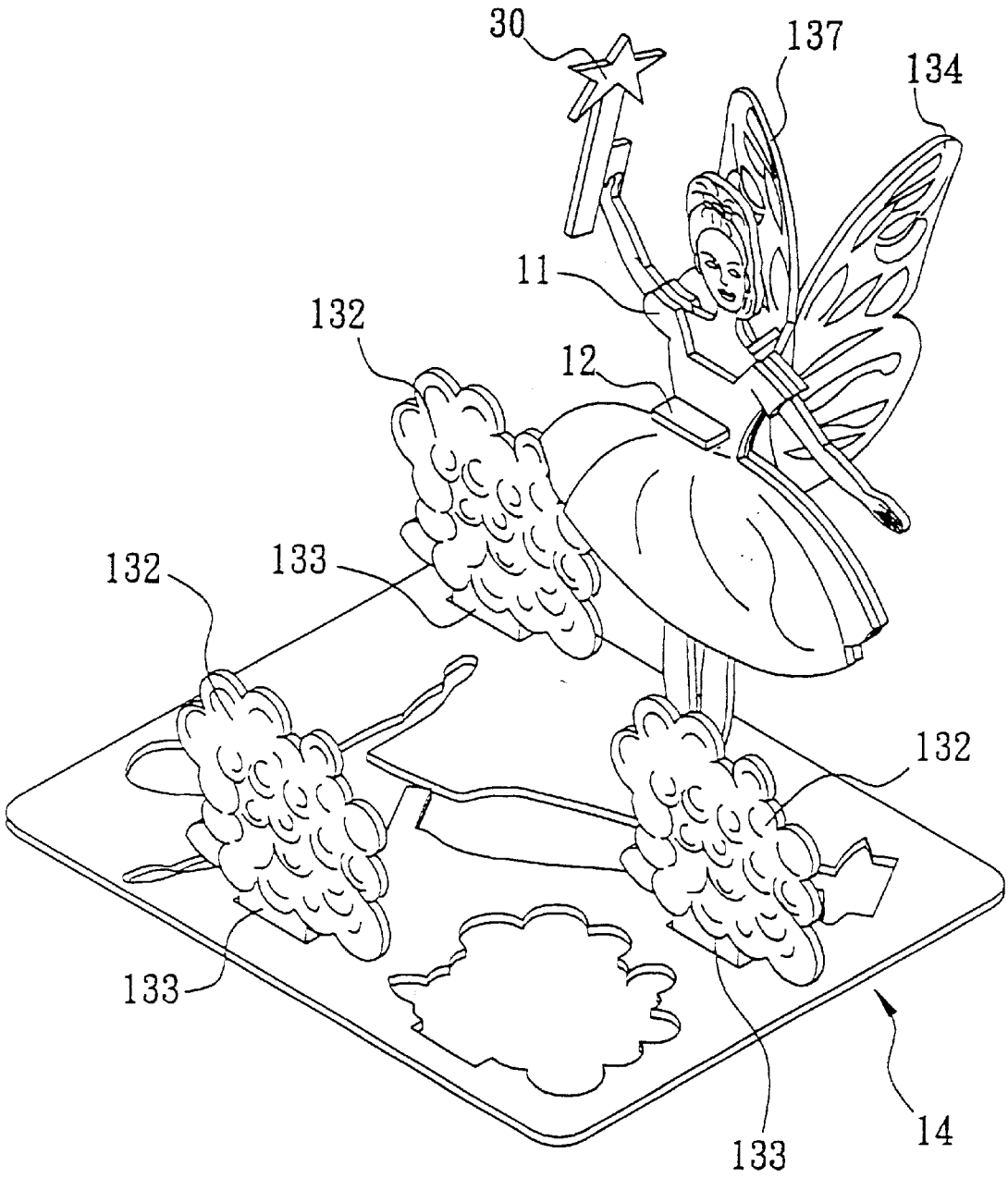
FIG. 4 is an assembled perspective view of a three-dimensional built-up toy with changeable clothes according to a second embodiment of the present invention.

FIG. 4 shows a second embodiment of the present invention.

In this second embodiment, the clothes 13 for the doll 11 include a first wing 134 and a second wing 137, and there are provided a plurality of clusters of flowers 132. The clusters of flowers 132 are provided at lower sides with downward extended insertion edges 133 for engaging with the insertion slots 141 on the base 14 and thereby vertically stand on the base 14. The coupling element 12 in this second embodiment includes, in addition to the second slit 121, a fourth slit 122 provided at a corner thereof to incline at a predetermined gradient. The first wings 134 is provided at a lower end of a predetermined connecting area with a fifth slit 135 for engaging with the fourth slit 122 on the coupling element 12. The wing 134 is also provided at an upper end of the predetermined connecting area with a sixth slit 136 for engaging with a seventh slit 138 provided at a lower end of a predetermined connecting area on the second wing 137, so that the second wing 137 is removably connected to the first wing 134. The wings 134, 137 are attached to a back of the doll 11 through engagement with the coupling-element 12 at the fourth slit 122. And, a magic stick 30 is connected to the doll's one hand.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A three-dimensional built-up toy with changeable clothes, comprising:

a flat doll piece having at one side adjacent to a middle portion a first slit having a predetermined depth, and a lower end with a downwardly extending connecting edge;

a flat coupling element piece having at one side a second slit engaging said first slit, said coupling element piece being perpendicularly connected to said doll piece through engagement of said second slit with said first slit;

a plurality of flat clothes pieces, each of which having, at one side at a position corresponding to said first slit on said doll piece, a third slit adapted to engage said coupling element piece, such that said clothes pieces are selectively attached to said doll piece through engagement of said third slit with said coupling element; and a flat base piece having, at predetermined positions, a plurality of insertion slots adapted to receive said connecting edge on said doll piece, such that said doll piece is upright connected to said base piece through engagement of said connecting edge with one of said insertion slots; wherein said plurality of flat clothes pieces each have different designs and patterns to be selectively attached to said doll.

2. The three-dimensional built-up toy with changeable clothes as claimed in claim 1, further comprising a plurality of toy furniture pieces attached to said base.

3. The three-dimensional built-up toy with changeable clothes as claimed in claim 2, wherein said toy furniture pieces comprise a plurality of flat pieces provided at lower ends with downward extended insertion edges adapted to engage said insertion slots on said base, such that said pieces of toy furniture are vertically connected to said base through engagement of said insertion edges with said insertion slots.

4. The three-dimensional built-up toy with changeable clothes as claimed in claim 1, further comprising first and second wings each having a connecting area provided thereon, and a plurality of flat flower cluster pieces each of said flower cluster piece being provided at a lower end with a downwardly extending insertion edge adapted to engage with any one of said insertion slots on said base for said flower cluster to stand on said base, said first and second wings being connected to said coupling element at said connecting areas.

* * * * *